US006092661A

United States Patent [19]

Mogil

[11] Patent Number: 6,092,661

[45] Date of Patent: Jul. 25, 2000

[54] PACK STRUCTURE

[75] Inventor: Melvin S. Mogil, Toronto, Canada

[73] Assignee: California Innovations Inc., Ontario, Canada

[21] Appl. No.: 09/122,088

[22] Filed: Jul. 24, 1998

[51] Int. Cl.[7] ..... B65D 69/00

[52] U.S. Cl. ..... 206/579; 206/523; 206/315.1; 150/106; 150/112

[58] Field of Search ..... 206/579, 545, 206/523, 547, 315.1, 315.3, 315.5, 315.9; 150/106, 107, 112, 113, 117, 120, 129, 130; 224/153, 584; 583/117, 40; 190/109, 127, 125, 102, 103, 110; 62/457.1, 457.4, 457.5, 457.7, 457.9

[56] References Cited

U.S. PATENT DOCUMENTS

| | | | |
|---|---|---|---|
| 2,827,096 | 3/1958 | Hinson | 150/52 |
| 3,001,566 | 9/1961 | Lipsitz | 150/12 |
| 4,192,365 | 3/1980 | Siegel | 150/35 |
| 4,378,866 | 4/1983 | Pelavin | 206/315 |
| 4,673,117 | 6/1987 | Calton | 224/151 |
| 4,767,039 | 8/1988 | Jacober | 224/151 |
| 5,054,589 | 10/1991 | Bomes et al. | 190/18 A |
| 5,217,119 | 6/1993 | Hollingworth | 206/583 |
| 5,228,547 | 7/1993 | Too | 190/103 |
| 5,288,150 | 2/1994 | Bearman | 383/38 |
| 5,649,658 | 7/1997 | Hoffman et al. | 224/576 |
| 5,884,768 | 3/1999 | Fox | 206/522 |
| 5,934,527 | 8/1999 | Von Neumann | 224/153 |

*Primary Examiner*—Paul T. Sewell
*Assistant Examiner*—Nhan T. Lam
*Attorney, Agent, or Firm*—Arent Fox Kintner Plotkin & Kahn PLLC

[57] ABSTRACT

An insulated pack has a main, insulated compartment suitable for holding refreshments at either a warmed or chilled temperature. It also has another compartment for valuables that has receptacles for such objects as cellular telephone handsets, wallets, and keys. It has a reinforced web framework structure, and a carrying handle mounted on the lid. Use of two of these packs, allows a user to keep different objects at different temperatures. The pack is particularly useful for attachment to a golf bag or golf cart to provide cool drinks during a round of golf.

20 Claims, 7 Drawing Sheets

PACK STRUCTURE

FIELD OF INVENTION

This invention relates generally to portable packs that include a cooling compartment. In particular it relates to a kind of portable pack that can be used in a number of outdoor activities, such as, for example, while golfing.

BACKGROUND OF THE INVENTION

People enjoying outdoor activities often desire refreshment. In the summer the usual desire is for something cool to drink. In the spring or fall a warm beverage or snack may be preferred. It may be that those persons wishing refreshment are a considerable distance from the nearest tea shop or refreshment stand. They may have hiked some distance, or, in the case of golf, have reached a point far out on the course. In such circumstances it is convenient to be able to take a supply of cooled or heated refreshments along, for use as desired.

Another related problem, particularly when golfing as a visitor, is that secure locker facilities may not be available. It is often uncomfortable to golf with a wallet or set of keys contained in one or another pants pocket. A golfer may wish to keep his or her valuables, such as a wallet and car keys, close at hand during a round of golf, in a container that is within the golfer's view. In recent times the growing popularity of cellular telephones has made it possible for golfers, hikers, cross country skiers, picnickers or others, to remain in touch with their business colleagues while enjoying their outdoor activities, often so smoothly that others may be scarcely aware that they are not at the office. A cellular telephone is another object that is uncomfortable to carry when golfing or skiing, for example. Cellular telephones are easily stolen and highly marketable. For both convenience of use and discouragement of theft they should be kept relatively close to the user. At the same time, the ability to carry, for example, extra golf balls, chocolate bars, or gum, and to carry a score card or map in a visible position, with enhanced accessibility are further common needs.

It may be uncomfortable, or cumbersome to having a multiplicity of objects to carry. A number of items may fit within a golf bag, along with various clubs, but the golf bag may not be sufficiently large to carry some items, and some items may risk damage if placed in the golf bag itself A golf bag is not generally a convenient place to have a cooling medium, such as ice cubes. Further, the prospect of spilling lemonade, carbonated drinks, or beer, however much by accident, inside either the golf bag amongst the woods and irons, or in a pocket of the golf bag, is not one that would be greeted with enthusiasm by many golfers. A segregated auxiliary carrying case that is separately washable, that is mountable to the golf bag, and that can be carried with it is preferable. It would be even more advantageous to have a pack that can be mounted with the golf bag when the bag is carried on a wheeled carriage or in a golf cart. In this way a golfer's hands are not further encumbered.

SUMMARY OF THE INVENTION

In a first aspect of the invention there is a pack. It has an insulated compartment, an auxiliary compartment mounted next to the insulated compartment and a mount for attaching the pack to another object. The auxiliary compartment has a receptacle of a size for receiving a telephone handset, another receptacle of a size for receiving a wallet, and a closure securable in a closed position to conceal the contents of the receptacles.

In an additional feature of that aspect of the invention, the pack has a breadth corresponding to the thickness of a golf bag. In another additional feature of that aspect of the invention, the pack has a second mount for inhibiting swaying of the pack relative to the other object. In a further additional feature of that aspect of the invention, the pack includes a see-through pocket mounted externally to the auxiliary compartment. The see-through pocket is of a size to receive a golf ball.

In another additional feature of that aspect of the invention, the pack has a leading panel for placement adjacent to the golf bag, a pair of side regions, a trailing region, a bottom and a top. A see-through pocket is mounted to one of said side regions. The see-through pocket has an access lip that has a leading portion and a trailing portion. The leading portion has a greater altitudinal dimension relative to said pocket than said trailing portion.

In a further additional feature of that aspect of the invention, the pack has a lid. The lid has a handle. The handle has a reinforced attachment to the lid, whereby, when closed, the pack can be carried by the handle.

In a still further additional feature of that aspect of the invention, the insulated compartment has a substantially impermeable liner, and the liner can be inverted to facilitate washing. In yet another additional feature, the insulating compartment has a thermal transfer medium holder, and that holder is vented.

In still another further additional feature of that aspect of the invention, the auxiliary compartment includes a key holder. In a still further feature of that additional feature, the key holder includes a lanyard secured within said auxiliary compartment.

In another aspect of the invention, there is an insulated pack. It has an insulated compartment. It has a first mount, for carrying the weight of the pack. The first mount is located on an upper region of the pack and is for attaching the pack to another object. The pack also has a second mount located on a lower region of the pack for attaching to the other object at a different location than the first mount.

In an additional feature of this aspect of the invention, the pack is reinforced at the location at which the first mount is attached to it. In another additional feature of the invention, the pack is reinforced at the location at which the second mount is attached to it. In a further additional feature, the first mount is a quick release hanging mount and the second mount is a cinch strap.

In another additional feature of that aspect of the invention, the pack further comprises a soft shell wall having leading portion, a trailing portion, a pair of side portions, and a bottom portion. The soft shell wall has an opening in the upper region. The opening has a rim. The pack has a lid for closing the opening, and an upper girth reinforcement for reinforcing said rim. It also has a lower girth reinforcement for reinforcing the lower region. In a further additional feature, the lid has a carrying handle, is moveable to a closed position, and has a securable closure whereby, when closed, the pack can be carried by the handle. In a yet further additional feature of that aspect of the invention, the soft shell wall is an insulating wall and forms the boundary of the insulated compartment. The auxiliary compartment is mounted externally of the soft shell wall.

In a yet further again additional feature of that aspect of the invention, the pack includes a see through pocket located externally on the soft shell wall and has an access opening that is tapered from a tall leading portion to a short trailing portion. In again another additional feature of that aspect of the invention, the soft shell wall is an insulating wall bounding the insulated compartment. The insulated compartment has a substantially impermeable liner mounted to the rim. The liner can be inverted to facilitate washing.

In another aspect of the invention there is a pack for mounting to a golf bag. It has an insulated compartment and an auxiliary compartment having a closure for concealing the contents thereof It also has a first mount for carrying the vertical load of the pack located on an upper region of the pack for attaching the pack to the golf bag. There is a second mount located on a lower region of the pack for attaching to the golf bag at a different location than the first mount.

DETAILED DESCRIPTION OF THE INVENTION

Figure 1:
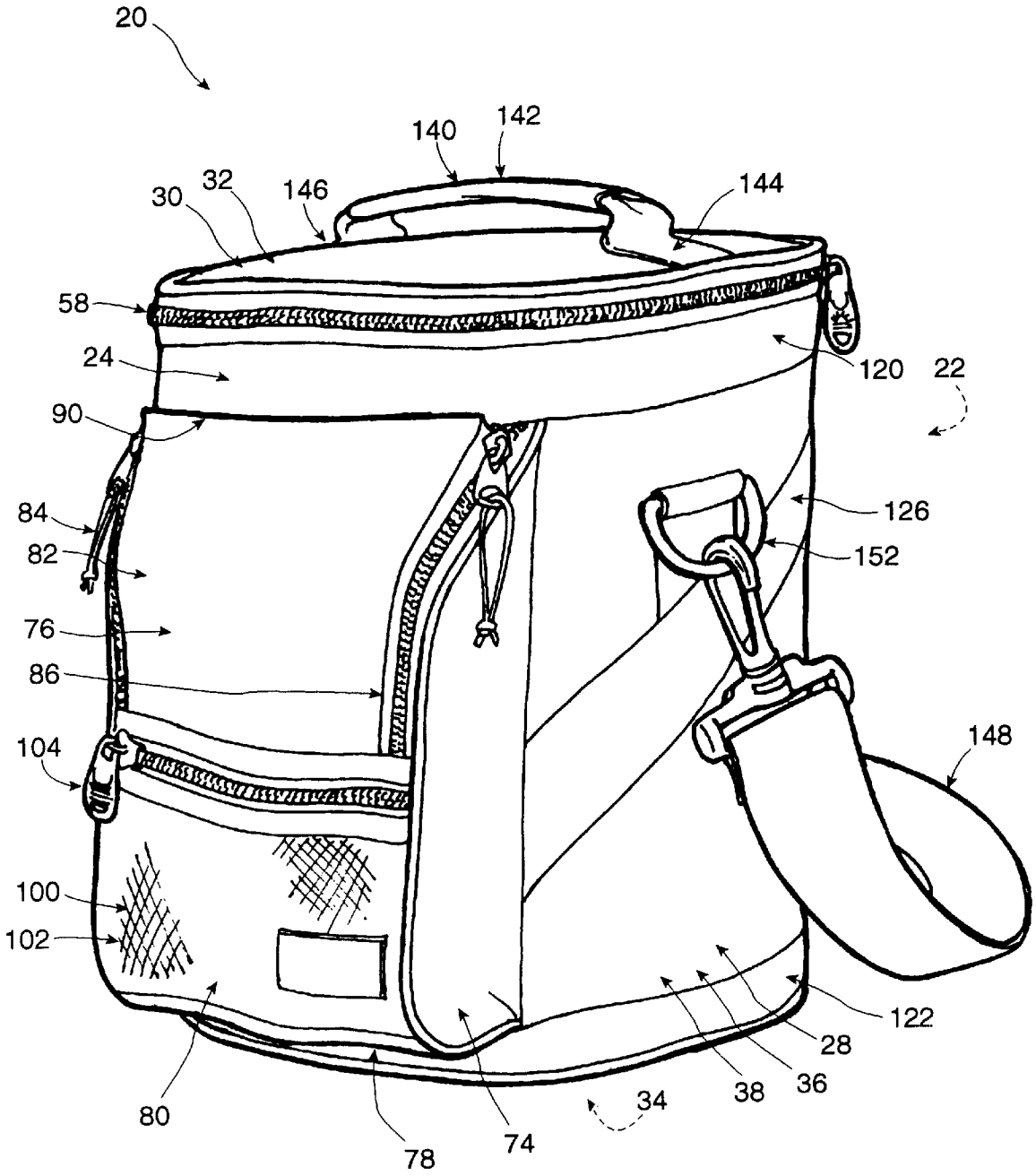
FIG. 1 is a General arrangement three quarter view of an example of a pack according to the principles of the present invention.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

Figure 2:
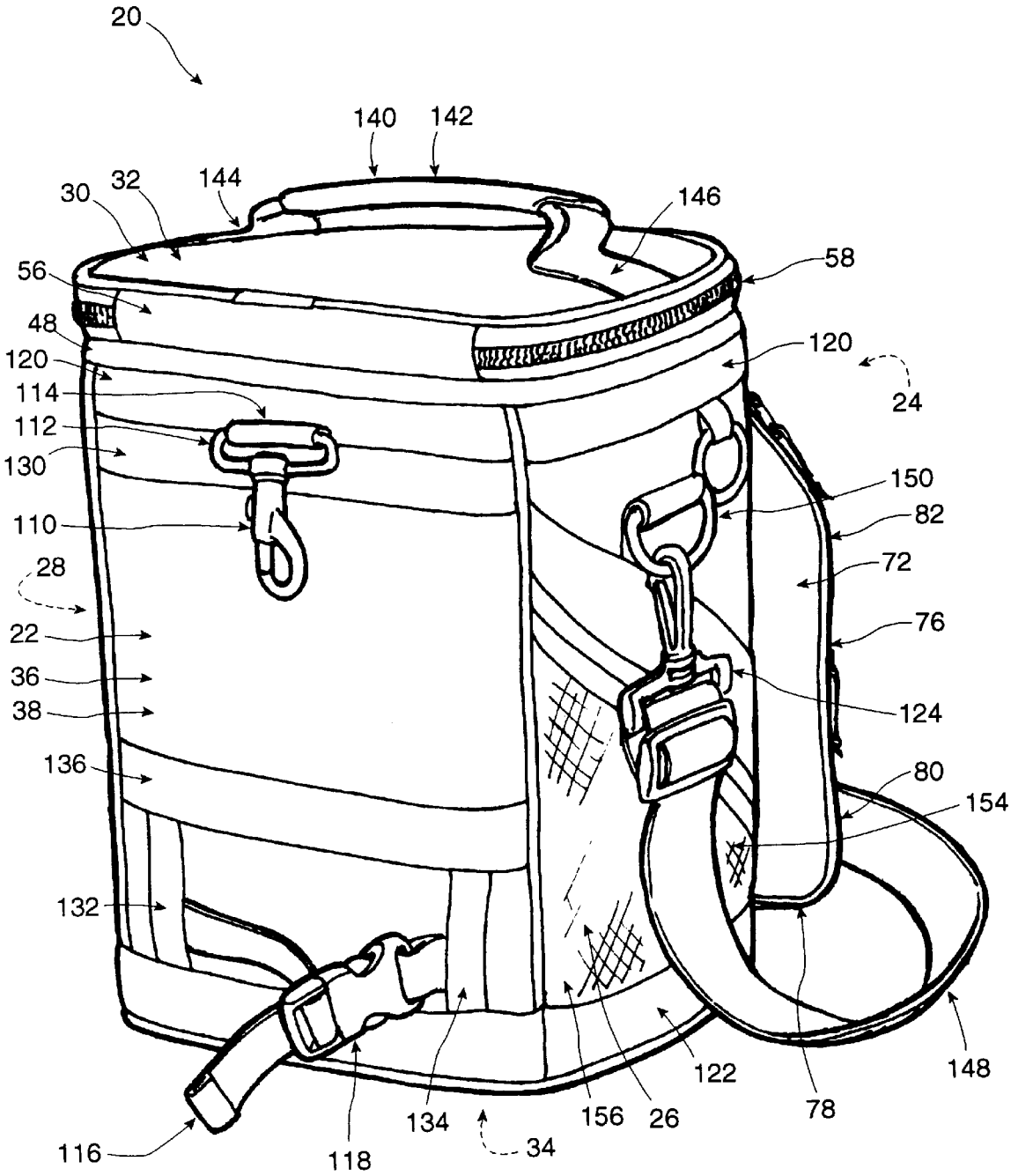
FIG. 2 is a view of the example of FIG. 1 taken on the opposite quarter of the same side, and from above, with a lid of the pack in an open position.
Figure 3:
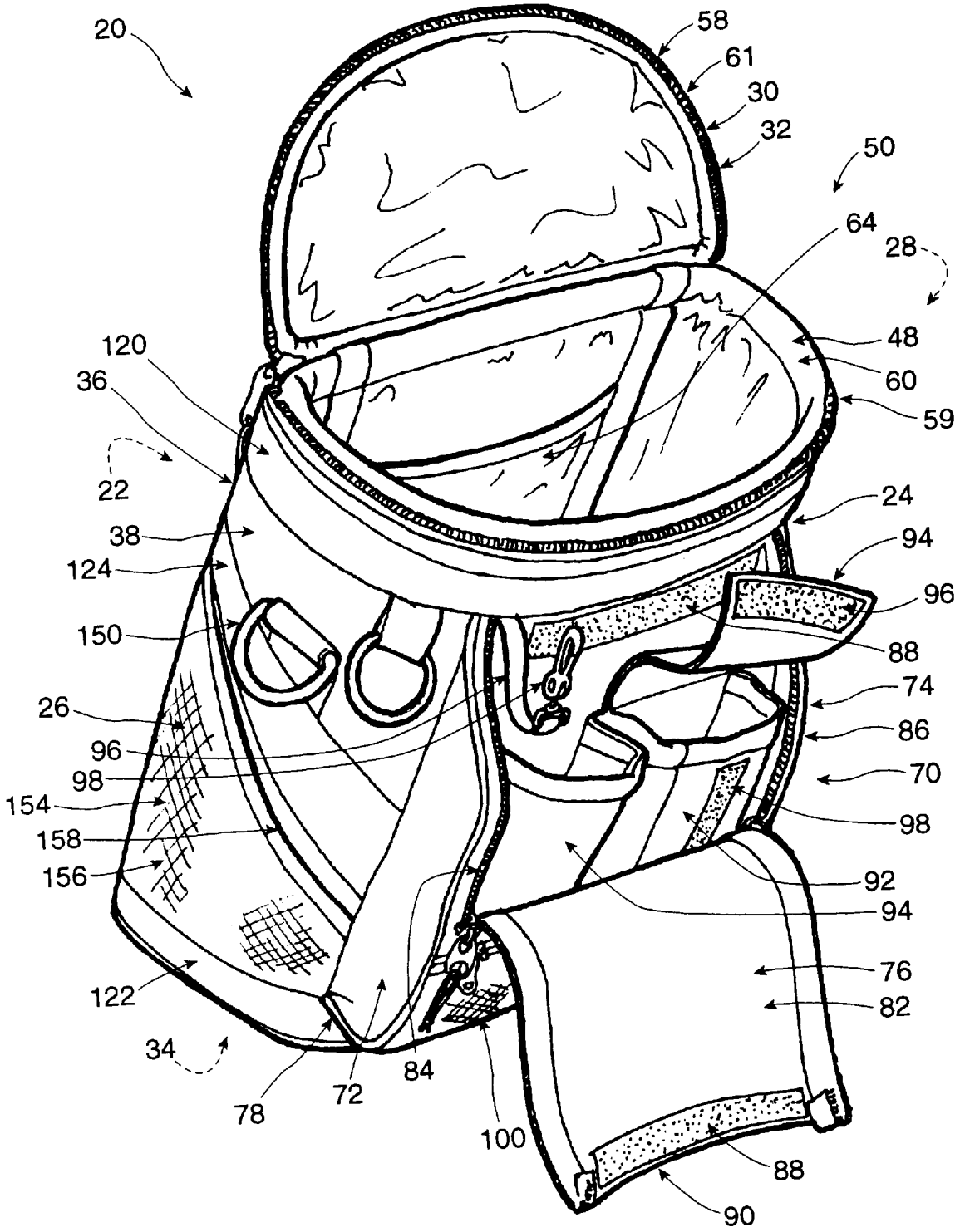
FIG. 3 is the opposite three quarter view to the view of FIG. 1.
Figure 7:
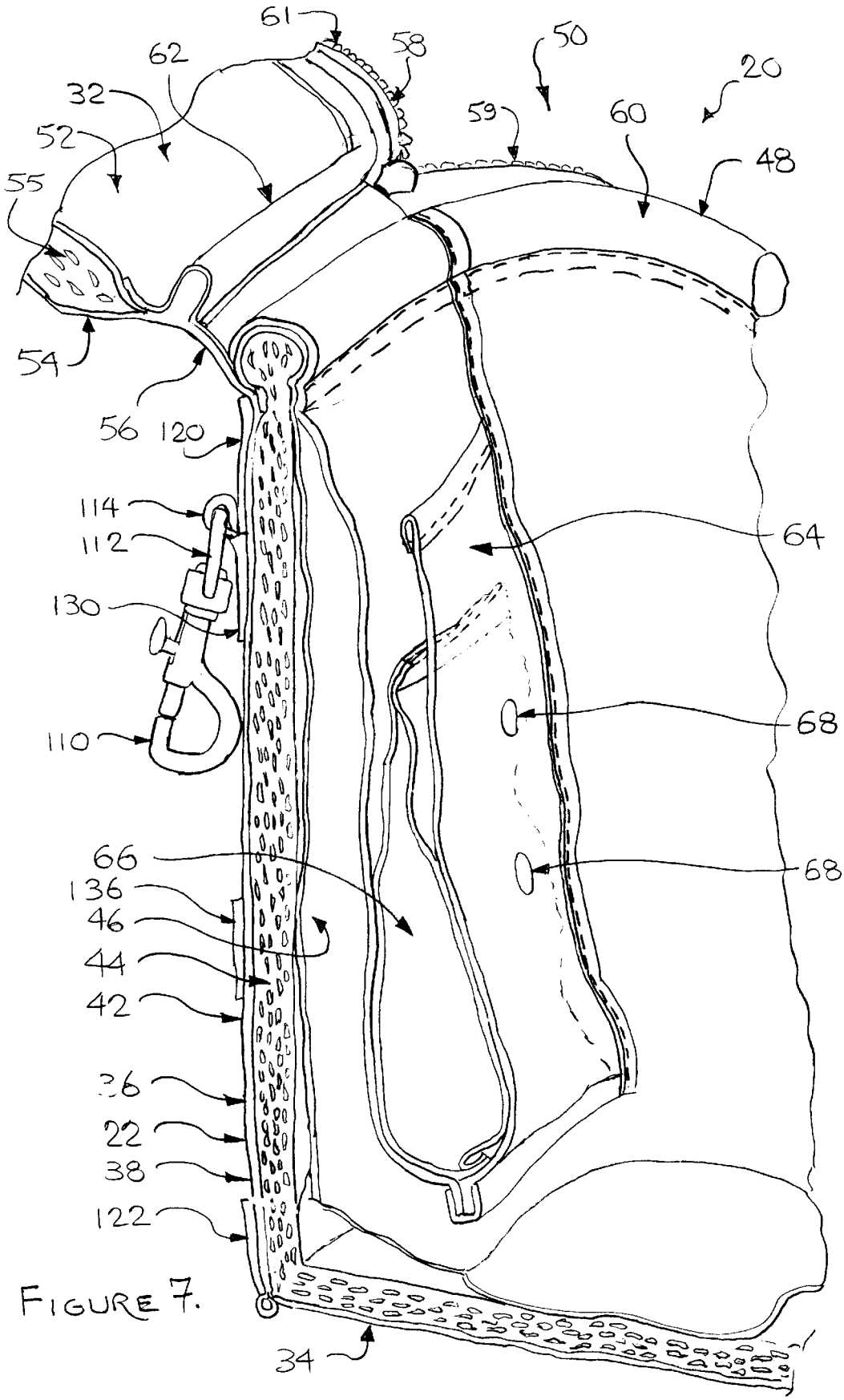
FIG. 7 shows a scab section of the pack of FIG. 1 showing a detail of a coolant pouch and a detail of the wall construction of the pack.

Referring to FIGS. 1, 2, and 3, an insulated pack having a shape that is generally similar to a golf bag, but on a smaller scale, is shown generally as 20. It has a leading portion 22, a trailing portion 24, a pair of left and right hand side portions 26 and 28, a top portion 30 having a lid 32, and a bottom portion 34. The major part of pack 20 is an insulated compartment 36 bounded by a modestly flexible soft shell insulating wall, 38, whose construction is shown in FIG. 7. The breadth of pack 20, that is, the overall width when viewed from the leading or trailing directions, is about 8½" empty. When undeformed pack 20 has a gently bulging D-shaped cross section when seen from above, similar to a golf bag, although this may change somewhat when loaded. The breadth is roughly the same as the thickness of a middling to large size of golf bag. Referring briefly to the detail of FIG. 7, wall 38 has an outer covering 42 of webbed construction, and an internal closed cell foam layer 44 within covering 42.

Further, liner 46 is not, in the example illustrated, fixed to the bottom of compartment 36, but can be pulled out of compartment 36 to an inverted position (while still remaining attached at rim 48) to facilitate washing with soap, and to facilitate drying, to discourage the grow of fungus and so on. Liner 46 has a single circumferential seam to join a bottom face, and a single wall seam running from the circumferential bottom seam to rim 48. In an optional alternative, liner 46 could be made from a polymer that has been impregnated with an antimicrobial compound prior to fabrication, a desirable feature for this kind of liner.

The top of compartment 36 is formed by generally D shaped lid 32. Lid 32 also has a through section structure of a flexible reflective inner layer, 52, a flexible skin in the nature of a canvas or webbing covering, 54, and a flexible closed cell insulation layer 55, (similar to layer 44, above) captured inbetween. Lid 32 is joined to the main body of pack 20, along the roughly straight side of the 'D' shape, by a hinge in the nature of a flexible fabric hinge 56, and a peripheral tracked closure in the nature of a zipper 58 having a pair of opposed zipper cars.

Rim 48 has a resiliently spongy beaded lip 60 wrapped within the upper edge of liner 46, adjacent to the set of zipper teeth 59 of zipper 58 that is mounted to the main body of pack 22. Lid 32 has a mating generally 'D' shaped peripheral lip 62 immediately next to the set of zipper teeth 61 of zipper 58 mounted to lid 32. When zipper 58 is closed, lip 62 is drawn down to bear on the outside surface of beaded lip 60, encouraging a sealing contact to be formed.

Within main compartment 36 a thermal transfer storage medium compartment is provided against a leading wall portion of insulating wall 38 by the use of a sack 64 for holding the thermal storage medium 66. Thermal storage medium 66 may be used as a source of heat to be transferred into the contents of compartment 36, that is, to maintain a warm temperature distribution in compartment 36. Alternatively, the thermal storage medium 66 can be used as a heat sink to maintain a cool, chilled, or freezing temperature distribution in the contents of compartment 36, as circumstances may require. Sack 64 has an array of perforations 68 to allow air to circulate through sack 64 more easily, facilitating drying of sack 64 after washing.

The second major component of insulated pack 20 is an auxiliary compartment in the nature of a valuables compartment 70, that is mounted to trailing portion 24, externally of soft shelled insulating wall 38. Compartment 70 has a pair of left and right hand side portions 72 and 74 that are connected to and extend vertically along, and rearwardly from the trailing portion of insulating wall 38; and a single piece trailing wall 76 extending between the distal extremities of side portions 72 and 74. In the preferred embodiment wall 76 is, like the rest of cover 42, made of a 600 denier polyester fabric, treated, as are all external surfaces of pack 20, to be stain and water resistant. Other wall fabrics can be used, such as leather or leather-like vinyl.

Wall 76 has a lower or underside area 78 that meets, and is joined to, the trailing portion of insulating wall 38. Underside area 78 forms the bottom of compartment 70. Wall 76 also has a medial, outer area 80 that extends roughly ⅔ of the way up compartment 70. An upper area 82 of wall 76, in the nature of a flap, is contiguous with outer area 80 on one edge, and has closures on the remainder of it periphery. Two of those closures are left and right hand vertical zippers, 84 and 86, that join with the uppermost parts of the distal edges of side portions 72 and 74. The third is a hook and eye fabric closure 88 for releasably attaching end lip 90 of wall 76 to insulated wall 38 just below rim 48.

Referring to FIG. 3, in which closures 84, 86 and 88 are undone, and upper area 82 lies open, a first receptacle, in the nature of a soft sided, durable fabric pocket 92 with a covering flap 94 has a horizontal hook and eye fastener part 96 mounted on its underside just inside its lip, for mating with a vertically aligned mating hook and eye fabric fastener part 98, the combination of orientations providing an adjustable size, and flexibility in closure position. Pocket 92 is of a size for carrying a cellular telephone handset, having a girth of roughly 5½" (roughly 1¼" deep sides and 3" breadth) and a depth of 6½" from bottom to lip. The interior of pocket 92 is lined with a cushioning material. Pocket 92 can be used for other objects than cellular telephones such as for sunglasses, a glasses case, or other item.

An adjacent receptacle in the nature of a soft-sided, open top pocket 94, without cover, has a convenient size (roughly 4½" girth, 5½" depth) for holding a deodorant container, or other object of similar size. It can, for example, be used as a storage space for a carrying strap. Adjacent to pocket 94 is a key holder in the nature of a lanyard 96 having one end fastened within compartment 70 just below rim 48. At its other, depending end lanyard 96 has a quick-release spring clip 98 for hooking about the ring of a key chain. Use of a strap, such as lanyard 96, makes it easy to retrieve keys, rather than having to fish around the bottom of compartment 70. The remaining enclosed space within medial outer area 80 and above underside area 78 has a height of roughly 4 inches, and a width of roughly 7 inches between the piping along the outer edges of side portions 72 and 74, leaving space for a wallet, or other items.

Other arrangements of closures are possible for auxiliary compartment 70. A single three sided zipper closure, with one or two zipper cars could be used, and the hook and eye fastener eliminated. Other kinds of fasteners, such as laces and grommets, interference fit seals, snaps, buttons, and so on are possible. The present arrangement is preferred. Similarly, other arrangements of receptacles and key holders, or like items can be used, although the present configuration is convenient, and preferred.

A vented, see-through pocket 100 is mounted externally to medial outer area 80, and is of a size for accommodating, for example, extra golf balls, gum, candy bars or other items. The open form mesh 102 permits objects in pocket 100 to dry more easily. Pocket 100 is closed by a sliding closure in the form of zipper 104.

A main attachment, suitable, for example, for hanging pack 20 from a golf bag, or for clipping pack 20 to a golf bag or golf cart, is shown as a quick release brass hook fitting 110 is mounted to an upper region of pack 20 on leading portion 22. Hook fitting 110 is free to revolve within its hinge fitting, 112, which itself is able to swing up and down within the confines of a broad loop of webbing 114.

A second attachment, suitable for tightening to another fastening location of a golf bag or golf cart, in the nature of an adjustable cinch strap 116 is mounted to a lower region of pack 20, also on leading portion 22. Strap 116 has a releasable catch 118, and can be used to tighten the lower region of pack 20 to a golf bag, golf cart, or other object, to restrain its swaying motion about the main attachment at hook fitting 110.

It is anticipated that a significant use of main insulated compartment 36 will be for carrying cans of liquid, such as carbonated beverages, fruit drinks, or beer, whether or not accompanied by ice cubes or crushed ice. Inasmuch as the preferred embodiment illustrated has a capacity of 12 cans of 385 ml plus ice, a load of 10 to 12 Lbs. (50 to 55 N) would not be unexpected. The height of the preferred embodiment illustrated to the lip of rim 48 is roughly 12 inches. Liner 46 is not taut when lying against the inner walls of compartment 36. That is, liner 46 has some slack, and is somewhat elastic in any event. Consequently load is taken up primarily, if not entirely, in soft shelled insulating wall, 38, and more specifically, principally in outer covering 42 of wall 38.

The main attachment at hook fitting 110 is able to carry the entire weight of pack 20, and the second attachment, at cinch strap 116, inhibits swaying of pack 20 about the first attachment. Outer covering 42 has an upper reinforcing band 120 extending externally about the periphery of insulating wall 38 next to rim 48. A lower reinforcing band 122 extends externally about the bottom edge of pack 20 where leading portion 22, trailing portion 24, and side portions 26 and 28 meet bottom portion 34, that is to say, about the lower region of pack 20.

A pair of left and right hand web doublers, 124 and 126 commence at a relatively high location at the leading edges of respective side portions 26 and 28, extend across the surface of those sides, and terminate at a lower location on the trailing edge of side portions 26 and 28. That is, they extend from the leading edge of the upper region, to the trailing edge of a lower region of pack 20.

The attachment of hook fitting 110 to pack 20 is reinforced by an upper lateral reinforcing band 130, in addition to upper reinforcing band 120, the effect being to spread the stress concentration out. Lateral reinforcing band 130 ends at the leading edges of side portions 26 and 28, close to the leading ends of doublers 124 and 126, yielding a reinforced load path between the lower region of pack 20 and hook fitting 110.

Similarly, each end of cinch strap 116 is sewn under a vertical left or right hand root reinforcement 132 or 134, each of these in turn leading to either lower reinforcing band 122 or a lower lateral reinforcement band 136, whose ends reach to the leading edges of side portions 26 and 28.

For ease and comfort of carrying pack 20 by hand, lid 32 is provided with a carrying handle 140 having a padded bail 142, and a pair of webbing feet 144 and 146 that extend fully to opposite points on the periphery of lid 32, such that loads carried through handle 140 are transmitted not only through the outer covering layer of lid 32 but also through the reinforcement of feet 144 and 146. At the edge of lid 32 the presence of upper reinforcing band 122 helps to spread the load more evenly to and from the vertical sidewalls formed by portions 22, 24, 26, and 28. Alternatively, pack 20 can be carried by a shoulder strap 148 fastened by spring clips to D-shaped rings 150 and 152, mounted on either of sides 26 and 28.

Left hand side portion 26 is provided with a trapezoidally shaped external pocket 154 having a breathing, see-through mesh 156 similar to mesh 102. A scorecard, or map, placed in this pocket can be seen for retrieval. Lip 158 of pocket 154 is set on a rake angle, yielding a somewhat larger opening for sliding a scorecard in, without having as carefully to fit it into a narrow opening as might otherwise be the case for a square cut pocket.

Figure 4:
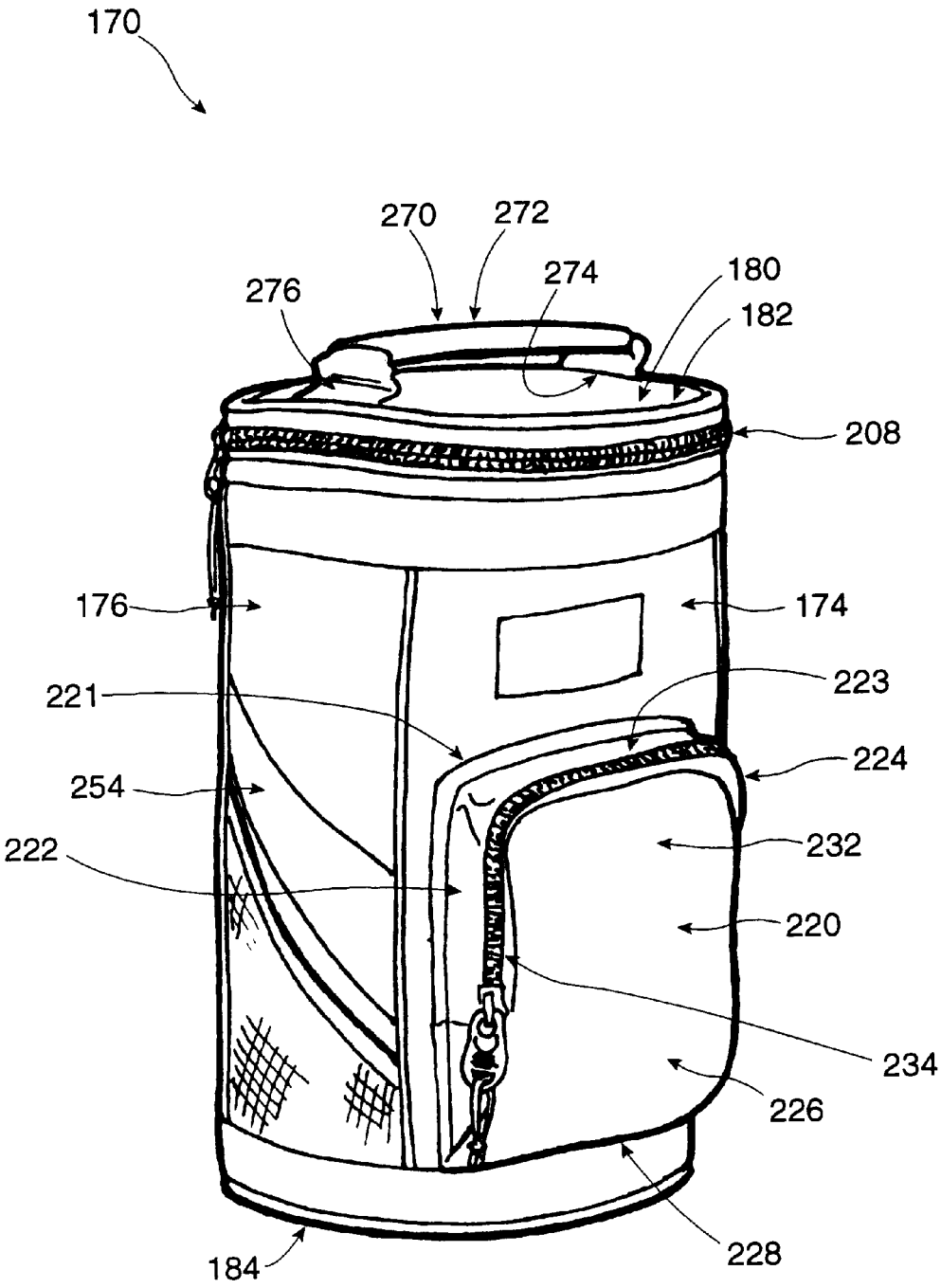
FIG. 4 is a three quarter view taken rearwardly and to the side of another pack according to the principles of the present invention.
Figure 5:
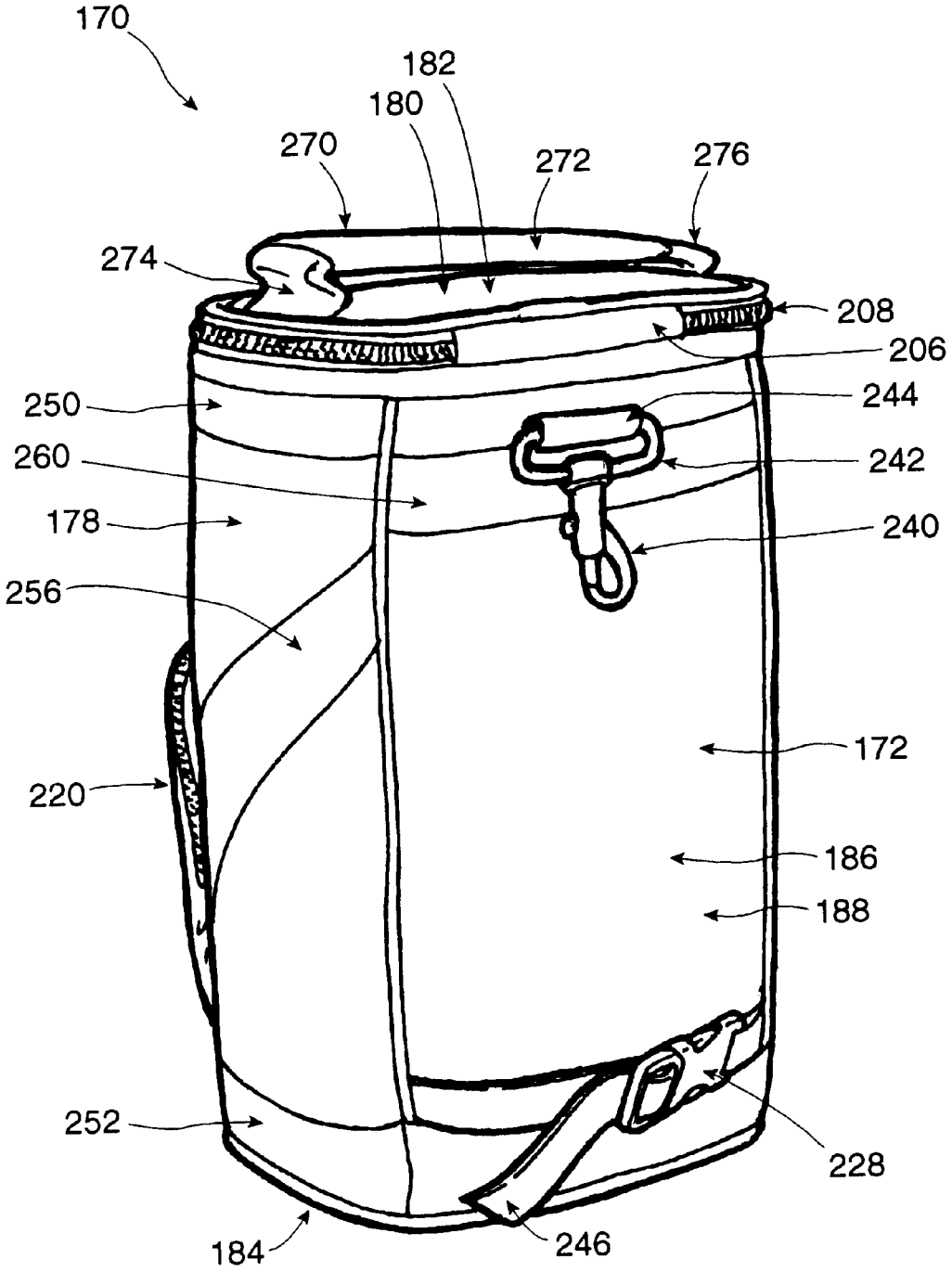
FIG. 5 shows the opposite three quarter view of the pack of FIG. 4.
Figure 6:
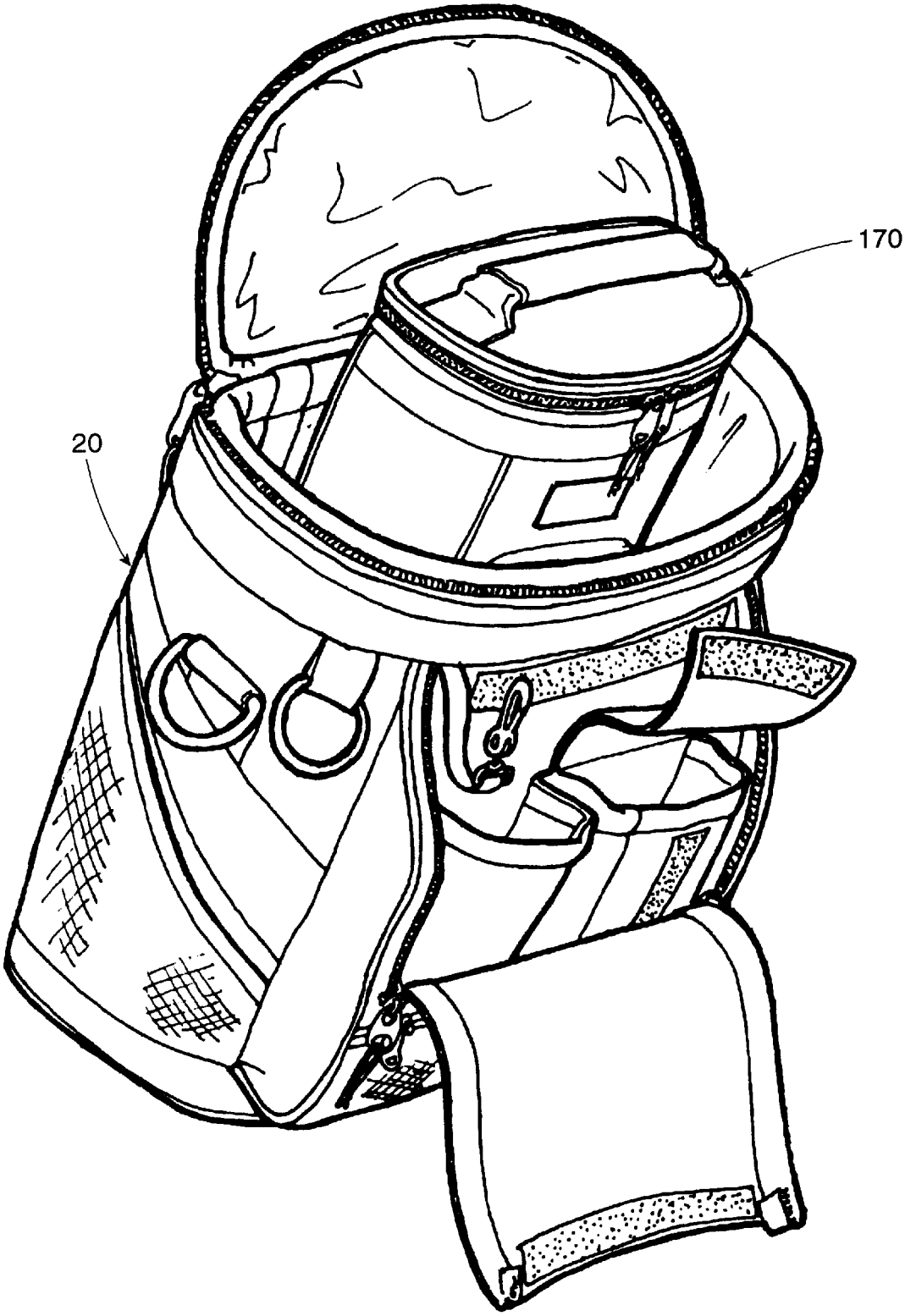
FIG. 6 shows a top view of the pack of FIG. 2, in an open state, with the pack of FIG. 4 partially nested therein.

Referring to FIGS. 4 and 5, a second insulated pack, is shown generally as 170. In this embodiment, pack 170 is of a size for carrying 5 cans. It has a leading portion 172, a trailing portion 174, a pair of left and right hand side portions 176 and 178, a top portion 180 having a lid 182, and a bottom portion 184. The major part of pack 170 is an insulated compartment 186 bounded by a modestly flexible soft shell insulating wall, 188, whose wall construction is the same as that shown in FIG. 7 and discussed above. The breadth of pack 170, that is, the overall width when viewed from the leading or trailing directions, is about 6½" empty. When undeformed pack 170 has a gently bulging D-shaped cross section when seen from above again, not dissimilar in general appearance to a golf bag. The breadth is roughly the same as the thickness of a small size of golf bag, and, is such that pack 170 can nest comfortably compartment 36 of pack 20. This is shown in FIG. 6.

The top of compartment 186 is formed by generally D shaped lid 182. Lid 182 has the same layered construction as lid 32. Lid 182 is joined to the main body of pack 170, along the roughly straight side of the 'D' shape, by a hinge in the nature of a flexible fabric hinge 206, and a peripheral tracked closure in the nature of a zipper 208 having a pair of 30 opposed zipper cars. The manner of closing lid 182 on compartment 186 of pack 170 is the same as for lid 36 of pack 20. Further, the same kind of substantially impermeable liner and thermal storage medium are used. The thermal storage medium is held in a sack like sack 64.

The second major component of insulated pack 170 is an auxiliary compartment in the nature of a valuables compartment 220, that is mounted to trailing portion 174, externally of soft shelled insulating wall 188. Compartment 220 has a generally downwardly opening, U-shaped member 221 that has pair of left and right hand side portions 222 and 224 that are connected to and extend vertically along, and rearwardly from the trailing portion of insulating wall 188 and a top cross portion 223 extending between them. Compartment 220 also has a single piece trailing wall 226 extending between the distal extremities of side portions 222 and 224. Wall 226 is made of canvas. Wall 226 has a lower or underside area 228, that meets and is joined to the trailing portion of insulating wall 188. Underside area 228 forms the bottom and lower trailing face of compartment 220. Wall 226 also has an upper area 232, being a flap contiguous with underside area 228 on one edge. Upper area 232 has a three sided wrap-around closure, being a zipper 234 that joins the corresponding edge of U-shaped member 221. As described above in the context of pack 20, compartment 220 has internal receptacles lined with cushioning for receiving valuables, glasses, keys, and so on.

A main attachment, suitable, for example, for hanging pack 170 from a golf bag, or for clipping pack 170 to a golf bag or golf cart, is shown as a quick release brass hook fitting 240, mounted to an upper region of pack 170 on leading portion 172. Hook fitting 240 is free to revolve within its hinge fitting, 242, which itself is able to swing up and down within the confines of a broad loop of webbing 244.

A second attachment, suitable for tightening to another fastening location of a golf bag or golf cart, in the nature of an adjustable cinch strap 246 is mounted to a lower region of pack 170, also on leading portion 172, but in this case being rooted at the outside edges of leading portion 172 where they meet the leading edges of side portions 176 and 178. Strap 246 has a releasable catch 220, and can be used to tighten the lower region of pack 170 to a golf bag, golf cart, or other object, to restrain its swaying motion about the main attachment at hook fitting 240.

Outer covering 192 has an upper reinforcing band 250 extending externally about the periphery of insulating wall 188 next to rim 198. A lower reinforcing band 252 extends externally about the bottom edge of pack 170 where leading portion 172, trailing portion 174, and side portions 176 and 178 meet bottom portion 184, that is to say, about the lower region of pack 170.

A pair of left and right hand doublers, 254 and 256 commence at a relatively high location at the leading edges of respective side portions 176 and 178, extend across the surface of those sides, and terminate at a lower location on the trailing edge of side portions 176 and 178.

The attachment of hook fitting 240 to pack 170 is reinforced by an upper lateral reinforcing band 260, in addition to upper reinforcing band 250, the effect being to spread the load out. Lateral reinforcing band 120 ends at the leading edges of side portions 176 and 178, close to the leading ends of doublers 254 and 256, yielding a reinforced load path between the lower region of pack 170 and hook fitting 240.

Lid 182 is provided with a carrying handle 270 having a padded bail 272, and a pair of webbing feet 274 and 276 that extend fully to opposite points on the periphery of lid 182, such that loads carried through handle 270 are transmitted not only through the outer covering layer of lid 182 but also through the reinforcement of feet 274 and 276. At the edge of lid 182 the presence of upper reinforcing band 252 helps to spread the load more evenly to and from the vertical sidewalls formed by portions 172, 174, 176, and 178.

Left hand side portion 176 is provided with a trapezoidally shaped external pocket 284 having a breathing, see-through mesh 286 similar to mesh 102. Lip 288 of pocket 384 is set on a rake angle.

A preferred embodiment has been described in detail and a number of alternatives have been considered. As changes in or additions to the above described embodiments may be made without departing from the nature, spirit or scope of the invention, the invention is not to be limited by or to those details, but only by the appended claims or their equivalents.

I claim:

1. A pack comprising:

a flexible, soft shell wall structure having a flexible insulated layer, a bottom portion, a top portion, and a sidewall structure, wherein said sidewall structure has a leading portion, a trailing portion and left and right side portions, said leading, trailing and left and right side portions of said sidewall structure extending between said top and bottom portions, wherein said portions of said soft shell wall structure co-operate to define therewithin an insulated compartment, said sidewall structure leading, trailing and left and and right side portions having upper margins, said upper margins co-operating to define an opening of said insulated compartment, wherein said top portion being a hingedly mounted lid, said lid being moveable to an open position to expose said opening of said insulated compartment, said sidewall structure also having a rim extending about said opening;

a liner mounted to said rim, said liner being positionable within said compartment and moveable to an inverted position to facilitate washing thereof;

a lifting member attached to said leading portion of said flexible soft shell wall structure;

said sidewall structure having a height, a depth, and a breadth, said height being greater than either of said depth and said breadth;

a secondary wall structure mounted to said trailing portion of said flexible soft shell wall structure to define an auxiliary compartment, said secondary wall structure having an auxiliary compartment closure member operable to give access to said auxiliary compartment.

2. The pack of claim 1, wherein said lifting member is a first mount operable to attach said pack to another object and said pack has a second mount to inhibit swaying of said pack relative to said another object to which said first mount is attached.

3. The pack of claim 1, wherein said pack includes a see-through pocket mounted externally to said auxiliary compartment.

4. The pack of claim 1, wherein said pack has a see-through pocket mounted to one of said side portions of said sidewall structure.

5. The pack of claim 1, wherein said lid has a handle mounted thereto, whereby, when said lid is closed, said pack can be carried by said lid.

6. The pack of claim 1, wherein said liner is impermeable and is attached continuously around said rim.

7. The pack of claim 6, wherein said insulating compartment has a thermal transfer medium holder mounted therein, and said holder is vented.

8. The pack of claim 1, wherein said lid is moveable to a closed position relative to said insulated compartment, said lid has an inside surface having a peripheral bead formed thereabout, wherein said inside surface faces toward said insulated compartment when said lid is in said closed position and said rim has an upwardly extending bead standing in opposition to said bead of said lid when said lid is in said closed position.

9. The pack of claim 1, wherein said auxiliary compartment has a key holder mounted therein.

10. The pack of claim 9 wherein said key holder includes a lanyard secured within said auxiliary compartment.

11. The pack of claim 1, wherein one of said side portions has a see-through side pocket, said pocket having a leading edge, a trailing edge and an opening between said leading and trailing edges;

said leading edge being longer than said trailing edge;

said auxiliary compartment has a see-through vented pocket mounted externally thereto; and said lid has a carrying handle attached thereto.

12. A pack comprising:

a flexible, soft shell wall structure having a flexible insulated layer, wherein said soft shell wall structure has a bottom portion, a top portion, and a sidewall structure, said sidewall structure having a leading portion, a trailing portion and left and right side portions, said leading, trailing and left and right side portions extending between said top and bottom portions, said portions of said soft shell wall structure co-operating to define therewithin an insulated compartment;

said sidewall structure leading, trailing and left and right side portions having upper margins, said upper margins co-operating to define an opening of said insulated compartment;

said top portion including a hingedly mounted lid, said lid being moveable to an open position to expose said opening of said insulated compartment;

said sidewall structure having a rim extending about said opening;

a liner mounted to said rim, said liner being positionable within said compartment, and said liner being moveable to an inverted position to facilitate washing thereof;

a lifting member attached to said leading portion of said sidewall structure; said lifting member being a first mount for carrying the weight of said pack for attachment when attached to another object;

a second mount located on said leading portion of said pack for attachment to the other object, said second mount being operable to inhibit swaying of said pack about said first mount;

said sidewall structure having a height measured from said bottom portion to said top portion, a depth measured from said leading portion to said trailing portion, and a breadth measured perpendicular to said height and said depth, said height being greater than either of said depth and said breadth; and an auxiliary compartment mounted to said trailing portion of said flexible soft shell wall structure, said auxiliary compartment having an auxiliary compartment closure member operable to give access to said auxiliary compartment.

13. The pack of claim 12 wherein said pack is reinforced at the location at which said first mount is attached to said pack.

14. The pack of claim 12 wherein said pack is reinforced at the location at which said second mount is attached to said pack.

15. The pack of claim 12 wherein said first mount is a quick release hanging mount and said second mount is a cinch strap.

16. The pack of claim 12, wherein said pack further comprises:

a girth reinforcement extending about said sidewall structure adjacent to said bottom portion of said pack.

17. The pack of claim 12 wherein said pack further comprises a girth reinforcement extending about said sidewall structure adjacent to said top portion of said pack.

18. The pack of claim 12, wherein said lid has a carrying handle mounted thereto; said lid is moveable to a closed position, relative to said insulated compartment; and said lid has a securable closure operable to fasten said lid in said closed position, whereby said pack can be carried by said carrying handle in said closed position.

19. The pack of claim 18, wherein said securable closure is a tracked fastener operable to attach said lid to said upper margins of said trailing and left and right hand side portions of said sidewall structure.

20. The pack of claim 12 wherein said pack includes a see-through pocket located externally on said sidewall structure, said pocket having an access opening that is tapered from a tall leading portion to a short trailing portion.

* * * * *

US006092661C1

(12) REEXAMINATION CERTIFICATE (4747th)

United States Patent

Mogil

(10) Number: US 6,092,661 C1

(45) Certificate Issued: Mar. 4, 2003

(54) PACK STRUCTURE

(75) Inventor: Melvin S. Mogil, Toronto (CA)

(73) Assignee: California Innovations Inc., Willowdale (CA)

Reexamination Request:
No. 90/005,962, Mar. 27, 2001

Reexamination Certificate for:

| | |
|---|---|
| Patent No.: | **6,092,661** |
| Issued: | **Jul. 25, 2000** |
| Appl. No.: | **09/122,088** |
| Filed: | **Jul. 24, 1998 09/122,088** |

(51) Int. Cl.[7] ..... B65D 69/00

(52) U.S. Cl. ..... 206/579; 206/523; 206/315.1; 150/106; 150/112

(58) Field of Search ..... 206/37.1, 37.4, 206/37.8, 315.1, 315.3, 523, 545, 579; 190/109, 110; 224/463, 572, 651; 383/110, 111; 62/457.1, 457.4, 457.5, 457.7, 457.9; 150/106, 107, 112, 113, 117, 120, 129, 130

(56) References Cited

U.S. PATENT DOCUMENTS

| | | | | |
|---|---|---|---|---|
| D234,181 | S | | 1/1975 | Haswell |
| 3,915,304 | A | | 10/1975 | Pasco et al. |
| 4,468,933 | A | | 9/1984 | Christopher |
| 4,537,313 | A | | 8/1985 | Workman |
| D288,653 | S | | 3/1987 | Crymes |
| 4,796,758 | A | * | 1/1989 | Haulk ..... 206/545 |
| 4,925,071 | A | | 5/1990 | Fleming et al. |
| D312,530 | S | | 12/1990 | Gallen et al. |
| 5,022,528 | A | | 6/1991 | Savoy |
| D323,242 | S | | 1/1992 | Costello |
| D330,631 | S | | 11/1992 | Ledbetter |
| 5,160,001 | A | | 11/1992 | Marceau |
| 5,400,610 | A | | 3/1995 | Macedo |
| D366,812 | S | | 2/1996 | Collins et al. |
| D369,065 | S | | 4/1996 | Sylvestre et al. |
| 5,505,307 | A | | 4/1996 | Shink |
| D371,942 | S | | 7/1996 | Lippincott et al. |
| 5,567,055 | A | | 10/1996 | Smith |
| 5,573,166 | A | * | 11/1996 | Leja ..... 224/651 |
| 5,620,140 | A | | 4/1997 | Utter |
| 5,640,855 | A | | 6/1997 | Crescenzo et al. |
| D387,198 | S | | 12/1997 | Lehmann et al. |
| 5,722,253 | A | | 3/1998 | Todd |
| 5,775,590 | A | | 7/1998 | Utter |
| 5,842,571 | A | | 12/1998 | Rausch |
| 5,938,646 | A | | 8/1999 | Carter |
| 5,967,415 | A | | 10/1999 | Utter |
| D419,770 | S | | 2/2000 | Mogil |
| D419,830 | S | | 2/2000 | Birutis et al. |
| 6,116,045 | A | | 9/2000 | Hodosh et al. |
| 6,237,776 | B1 | | 5/2001 | Mogil |
| 6,238,091 | B1 | | 5/2001 | Mogil |

OTHER PUBLICATIONS

Exhibit A—Single page advertisement for Arctic Zone Golf Cooler.

* cited by examiner

*Primary Examiner*—Luan K. Bui

(57) ABSTRACT

An insulated pack has a main, insulated compartment suitable for holding refreshments at either a warmed or chilled temperature. It also has another compartment for valuables that has receptacles for such objects as cellular telephone handsets, wallets, and keys. It has a reinforced web framework structure, and a carrying handle mounted on the lid. Use of two of these packs, allows a user to keep different objects at different temperatures. The pack is particularly useful for attachment to a golf bag or golf cart to provide cool drinks during a round of golf.

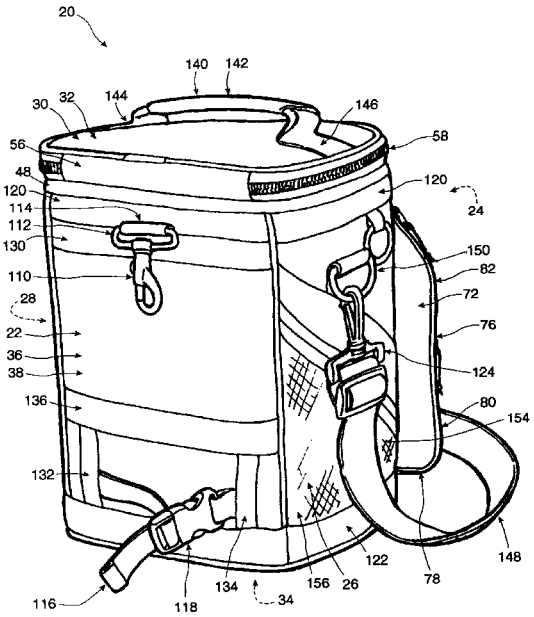

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is cancelled.

Claims 2–6, 8, 9, 11 and 12 are determined to be patentable as amended.

Claims 7, 10 and 13–20, dependent on an amended claim, are determined to be patentable.

2. [The pack of claim 1,] *A pack comprising:*

*a flexible, soft shell wall structure having a flexible insulated layer, a bottom portion, a top portion, and a sidewall structure;*

*said sidewall structure having a leading portion, a trailing portion and left and right hand side portions,*

*said leading, trailing and left and right hand side portions of said sidewall structure extending between said top and bottom portions;*

*said portions of said soft shell wall structure co-operating to define therewithin an insulated compartment;*

*said sidewall structure leading, trailing and left and right hand side portions having upper margins, said upper margins co-operating to define an opening of said insulated compartment;*

*said top portion being a hingedly mounted lid, said lid being moveable to an open position to expose said opening of said insulated compartment;*

*said sidewall structure also having a rim extending about said opening;*

*a liner mounted to said rim, said liner being positionable within said compartment, said liner being moveable to an inverted position to facilitate washing thereof;*

*a lifting member attached to said leading portion of said flexible soft shell wall structure;*

*said sidewall structure having a height measured from said bottom portion to said top portion, a depth measured from said leading portion to said trailing portion, and a breadth measured perpendicular to said height and said depth, said height being greater than either of said depth and said breadth, said breadth being greater than said depth;*

*a secondary wall structure mounted to said trailing portion of said flexible soft shell wall structure to define an auxiliary compartment, said secondary wall structure having an auxiliary compartment closure member operable to give access to said auxiliary compartment;* wherein said lifting member is a first mount operable to attach said pack to another object and said pack has a second mount to inhibit swaying of said pack relative to said another object to which said first mount is attached.

3. The pack of claim [1] *2*, wherein said pack includes a see-through pocket mounted externally to said auxiliary compartment.

4. The pack of claim [1] *2*, wherein said pack has a see-through pocket mounted to one of said side portions of said sidewall structure.

5. The pack of claim [1] *2*, wherein said lid has a handle mounted thereto, whereby, when said lid is closed, said pack can be carried by said lid.

6. The pack of claim [1] *2*, wherein said liner is impermeable and is attached continuously around said rim.

8. The pack of claim [1] *2*, wherein said lid is moveable to a closed position relative to said insulated compartment, said lid has an inside surface having a peripheral bead formed thereabout, wherein said inside surface faces toward said insulated compartment when said lid is in said closed position and said rim has an upwardly extending bead standing in opposition to said bead of said lid when said lid is in said closed position.

9. The pack of claim [1] *2*, wherein said auxiliary compartment has a key holder mounted therein.

11. The pack of claim [1] *2*, wherein one of said side portions has a see-through side pocket, said pocket having a leading edge, a trailing edge and an opening between said leading and trailing edges;

said leading edge being longer than said trailing edge;

said auxiliary compartment has a see-through vented pocket mounted externally thereto; and said lid has a carrying handle attached thereto.

12. A pack comprising:

a flexible, soft shell wall structure having a flexible insulated layer, wherein said soft shell wall structure has a bottom portion, a top portion, and a sidewall structure, said sidewall structure having a leading portion, a trailing portion and left and right side portions, said leading, trailing and left and right side portions extending between said top and bottom portions, said portions of said soft shell wall structure co-operating to define therewithin an insulated compartment;

said sidewall structure leading, trailing and left and right side portions having upper margins, said upper margins co-operating to define an opening of said insulated compartment;

said top portion, including a hingedly mounted lid, said lid being movable to an open position to expose said opening of said insulated compartment;

said sidewall structure having a rim extending about said opening;

a liner mounted to said rim, said liner being positionable within said compartment, and said liner being movable to an inverted position to facilitate washing thereof;

a lifting member attached to said leading portion of said sidewall structure;

said lifting member being a first mount for carrying the weight of said pack for attachment when attached to another object;

a second mount located on said leading portion of said pack for attachment to the other object, said second mount being operable to inhibit swaying of said pack about said first mount;

said sidewall structure having a height measured from said bottom portion to said top portion, a depth measured from said leading portion to said trailing portion, and a breadth measured perpendicular to said height and said depth, said height being greater than either of said depth and said breadth, *said breadth being greater than said depth*; and an auxiliary compartment mounted to said trailing portion of said flexible soft shell wall structure, said auxiliary compartment having an auxiliary compartment closure member operable to give access to said auxiliary compartment.

* * * * *